US009046206B2

(12) United States Patent
Chien

(10) Patent No.: US 9,046,206 B2
(45) Date of Patent: Jun. 2, 2015

(54) GAS SUPPLY DEVICE

(71) Applicant: Ming Kun Chien, Taichung (TW)

(72) Inventor: Ming Kun Chien, Taichung (TW)

( * ) Notice: Subject to any disclaimer, the term of this patent is extended or adjusted under 35 U.S.C. 154(b) by 342 days.

(21) Appl. No.: 13/745,026

(22) Filed: Jan. 18, 2013

(65) Prior Publication Data

US 2013/0248012 A1 Sep. 26, 2013

(30) Foreign Application Priority Data

Mar. 22, 2012 (TW) ..... 101205130 U

(51) Int. Cl.

| | |
|---|---|
| ***F01C 21/04*** | (2006.01) |
| ***F01C 21/06*** | (2006.01) |
| ***F03C 2/00*** | (2006.01) |
| ***F03C 4/00*** | (2006.01) |
| ***F04C 29/02*** | (2006.01) |
| ***F04C 29/04*** | (2006.01) |
| ***F04C 2/00*** | (2006.01) |
| ***F04C 15/00*** | (2006.01) |
| ***F04C 27/02*** | (2006.01) |
| ***F16L 53/00*** | (2006.01) |
| ***F04C 18/16*** | (2006.01) |

(52) U.S. Cl.

CPC ..... *F16L 53/00* (2013.01); *F04C 29/026* (2013.01); *F04C 29/042* (2013.01); *F04C 18/16* (2013.01)

(58) Field of Classification Search

CPC ..... F04C 18/16; F04C 18/042; F25B 29/003
USPC ..... 137/171, 173, 177, 179, 207.5, 334, 137/338, 340; 62/93, 95, 512
See application file for complete search history.

(56) References Cited

U.S. PATENT DOCUMENTS

| | | | | |
|---|---|---|---|---|
| 4,033,048 | A * | 7/1977 | Van Ike | 34/92 |
| 4,711,771 | A * | 12/1987 | Schiller | 423/359 |
| 5,699,672 | A * | 12/1997 | Foerster et al. | 62/86 |
| 6,149,408 | A * | 11/2000 | Holt | 418/1 |
| 2005/0089432 | A1 * | 4/2005 | Truyens et al. | 418/83 |
| 2011/0014077 | A1 * | 1/2011 | Martens | 418/84 |

* cited by examiner

*Primary Examiner* — Craig Schneider
*Assistant Examiner* — Kelsey Rohman
(74) *Attorney, Agent, or Firm* — Wang Law Firm, Inc.; Li K. Wang; Stephen Hsu

(57) ABSTRACT

A gas supply device has an air compressor, a liquid-gas separator, and a freeze-drying mechanism. The air compressor discharges high-pressure gas with a high temperature and containing a liquid to the liquid-gas separator. The high-pressure gas separated by the liquid-gas separator then enters the freeze-drying mechanism for cooling. The freeze-drying mechanism has a drainer for removing water in the high-pressure gas. The removed water goes through a drain line to the liquid-gas separator to be discharged. The liquid in the liquid-gas separator has a cooling effect.

7 Claims, 4 Drawing Sheets

GAS SUPPLY DEVICE

CROSS REFERENCE TO RELATED APPLICATION

This application claims the benefit of priority to TW 101205130, filed in the Taiwanese Intellectual Property Office, the entire specification of which is incorporated herein by reference.

BACKGROUND OF THE INVENTION

1. Field of Invention

The invention relates to a gas supply device and, in particular, to a gas supply device with extremely good cooling effects and capable of effectively reducing noises and device volume.

2. Related Art

As shown in FIG. 4, the conventional air compressor system comprises a compressor 71, a liquid-gas separator 72, a heat-dissipating device 73, and a freeze-drying device. The compressor 71 compresses air. The freeze-drying device consists of a refrigerant heat exchange structure 74, including a refrigerant compressor, the cold exhaust, fans, and so on, and a drain 75. The gas compressed by the compressor 71 is a high-temperature and high-pressure gas containing lubricating oil for lubrication and sealing. Therefore, the gas compressed by the compressor 71 needs to be first processed by the liquid-gas separator 72 to remove the liquid therein. The liquid-gas separator 72 separates the liquid from the high-temperature high-pressure gas containing the liquid. The liquid separated by the liquid-gas separator 72 flows via a reflow pipe 76 back to the liquid cooling part 731 of the heat dissipation device 73 and then back to the compressor 71 for reuse. The wet high-pressure gas separated by the liquid-gas separator 72 goes via a transport line 77 to the gas cooling part 732 of the heat dissipation device 73. The gas cooling part 732 performs preliminary cooling on the high-pressure gas, which is then sent to the freeze-drying device for the second heat exchange cooling and moisture removal. Afterwards, the high-pressure can be output for use.

The air compressor systems normally used in production lines release high-temperature and high-pressure gas containing a liquid via the compressor 71 thereof. Therefore, the cooling device 73 is required for heat dissipation. However, most of the cooling devices 73 in the conventional air compressor systems adopt fan cooling. In addition to additional power driving and consuming more power, there are still the drawbacks of loud noises and flying dusts. Moreover, the system occupies too much of the space in factory.

SUMMARY OF THE INVENTION

An objective of the invention is to provide a gas supply device, which has an excellent cooling effect and can effectively reduce noises and device volume.

To achieve the above-mentioned objective, the disclosed gas supply means comprises: an air compressor, a liquid-gas separator, and a freeze-drying mechanism.

The air compressor has an inlet and an outlet.

The liquid-gas separator is located at the outlet of the air compressor. The air compressor discharges a high-temperature, high-pressure gas containing a liquid via the outlet to the liquid-gas separator, which then separates the high-pressure gas from the liquid. The separated high-pressure gas is output via a first air supply pipe, while the separated liquid flows via a reflow pipe back to the air compressor.

The freeze-drying mechanism has a cooling pipeline connected with the first air supply pipe. Around the cooling pipeline is provided with a heat exchanger for cooling the high-pressure gas therein. The outlet of the cooling pipe is connected with a drainer, which removes moisture of the high-pressure gas coming via the cooling pipeline. The drainer has a second air supply pipe and a drainer line, which extends and goes through the liquid-gas separator. The moisture-removed high-pressure gas is output via the second air supply pipe. The removed moisture travels along the drainer line, through the liquid-gas separator, and leaves the disclosed air supply device.

Furthermore, a pre-cooling unit is interposed between the first air supply pipe and the cooling pipeline. The pre-cooling unit has a hollow barrel shape and has a plurality of gas pipes across the interior thereof. The pre-cooling unit has a first inlet, a first outlet, a second inlet and a second outlet. The first inlet and the first outlet communicate respectively with the internal space of the pre-cooling unit, while the second inlet and the second outlet communicate respectively with each of the gas pipelines. The first air supply pipe connects to the first inlet, the cooling pipeline connects to the first outlet, and the second air supply pipe connects to the second inlet.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
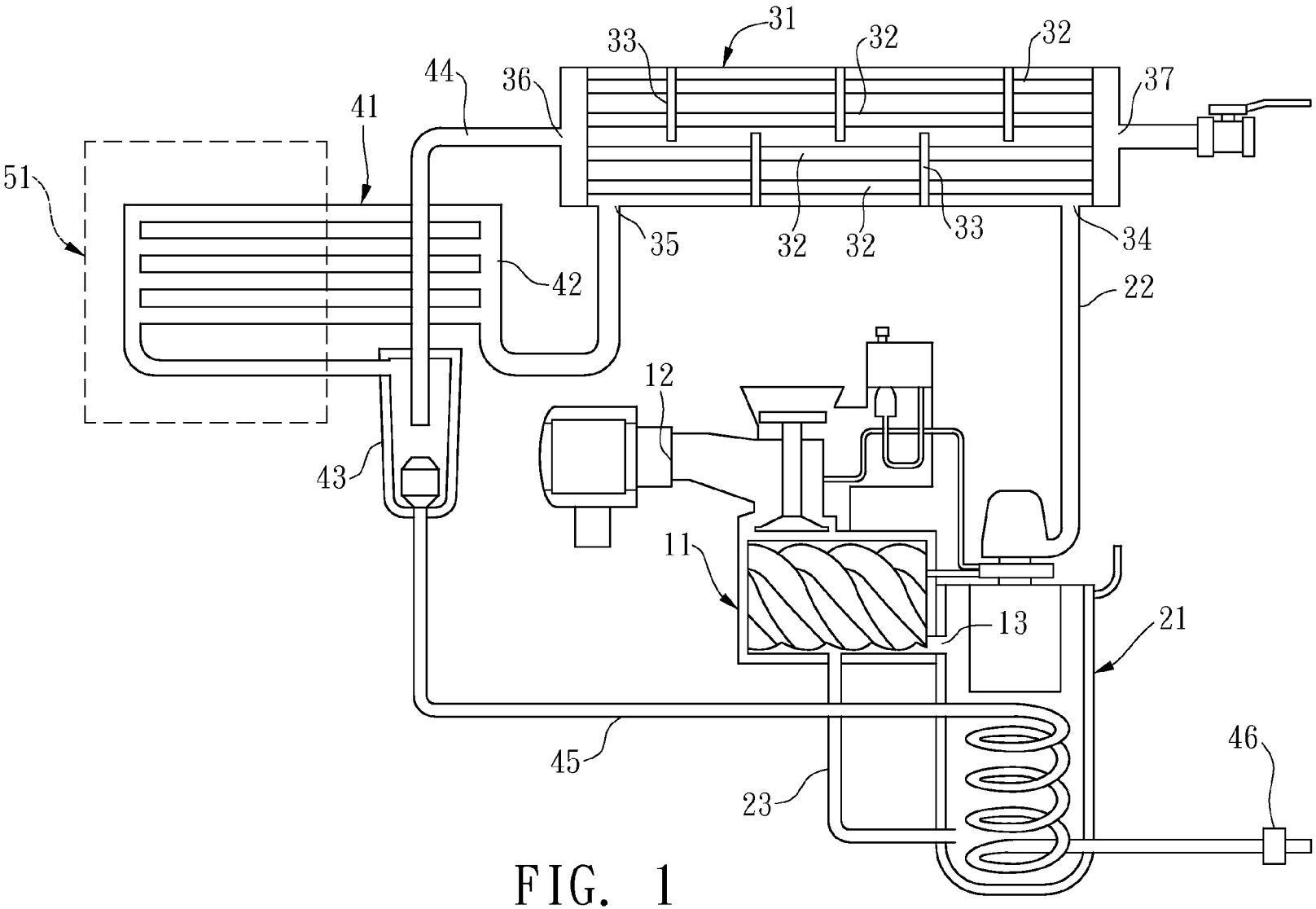
FIG. 1 is a schematic view of the structure of the invention.

Please refer to FIG. 1. The invention provides a gas supply device, composed mainly by an air compressor 11, a liquid-gas separator 21, a pre-cooling unit 31, and a freeze-drying mechanism 41.

The air compressor 11 has an inlet 12 and an outlet 13. The air compressor 11 compresses the air entering via the air inlet 12 and discharges the compressed air via the outlet 13.

The liquid-gas separator 21 is provided at the outlet 13 of the air compressor 11. The high-temperature, high-pressure air containing a liquid discharged by the outlet 13 of the air compressor 11 enters the liquid-gas separator 21 to separate the high-pressure gas and the liquid. The separated moist high-pressure gas is output via a first air supply pipe 22, while the separated liquid goes via a reflow pipe 23 back to the air compressor 11.

The pre-cooling unit 31 has a hollow barrel shape. There are several gas pipes 32 and several gratings 33 disposed in an alternating way horizontally across the interior of the pre-cooling unit 31. The pre-cooling unit 31 further has a first inlet 34, a first outlet 35, a second inlet 36, and a second outlet 37. The first inlet 34 and the first outlet 35 are in communications with the internal space of the pre-cooling unit 31. The second inlet 36 and the second outlet 37 are in communications with the gas pipes 32. The first air supply pipe 22 connects to the first inlet 34, so that the moist high-pressure gas separated by the liquid-gas separator 21 enters the pre-cooling unit 31 through the first inlet 34 and leaves via the first outlet 35.

The freeze-drying mechanism 41 has a cooling pipeline connecting to the first outlet 35 of the pre-cooling unit 31, so that the moist high-pressure gas output by the first outlet 35 of the pre-cooling unit 31 enters the cooling pipeline 42. The cooling pipeline 42 is surrounded by a heat exchanger 51 for cooling the moist high-pressure gas in the cooling pipeline. The outlet of the cooling pipeline 42 is a drainer 43 for removing the moisture in the moist high-pressure gas in the cooling pipeline 42. The drainer 43 has a second air supply pipe 44 and a drainer pipe 45, which extends and goes through the liquid-gas separator 21. Moreover, the drainer pipe 45 going through the liquid-gas separator 21 has a continuous meander shape. The moisture removed by the drainer 43 travels along the drainer pipe 45 and leaves the liquid-gas separator 21. Moreover, the outlet of the drainer pipe 45 is provided with a timing valve 46, which controls the timing for opening the outlet of the drainer pipe 45. The high-pressure gas with moisture removed by the drainer 43 is output by the second air supply pipe 44. The second air supply pipe 44 connects to the second inlet 36 of the pre-cooling unit 31. The moisture-removed high-pressure gas then enters the gas pipes 32 via the second inlet 36 of the pre-cooling unit 31, and leaves from the second outlet 37 of the pre-cooling unit 31.

It should be noted that the disclosed heat exchanger 51 around the cooling pipeline 42 for cooling the high-pressure gas therein can be composed of a refrigerant heat exchange structure, a refrigeration chipset or other equivalent heat exchange cooling devices.

Figure 2:
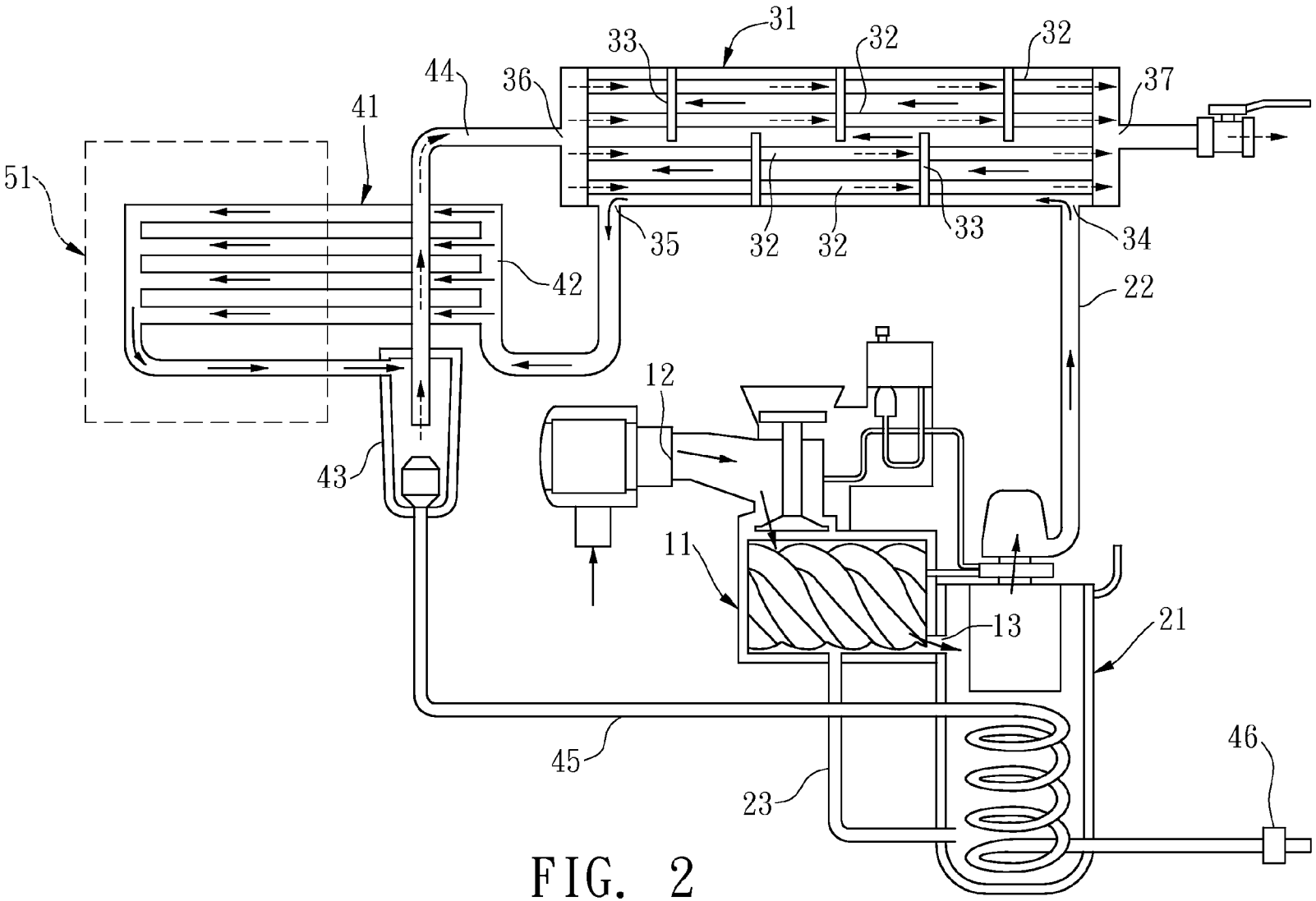
FIG. 2 is a schematic view of the path of the high-pressure gas in the invention.

FIG. 2 shows the invention in use. When the air compressor 11 starts its operation, external air is sucked into the inlet 12. The compressed high-temperature, high-pressure gas containing a liquid is discharged via the outlet 13 to the liquid-gas separator 21. Afterwards, the liquid-gas separator 21 separates the high-temperature, high-pressure gas containing a liquid into a moist high-temperature, high-pressure gas and a high-temperature liquid. The moist high-temperature, high-pressure gas goes through the first air supply pipe 22 and the first inlet 34 of the pre-cooling unit 31 into the interior of the pre-cooling unit 31, and then enters the cooling pipeline 42 via the first outlet 35 of the pre-cooling unit 31. The moist high-temperature, high-pressure gas entering the cooling pipeline 42 is cooled by the heat exchanger 51 and then sent into the drainer 43. The drainer 43 removes the moisture in the moist high-pressure gas, thereby obtaining a low-temperature, dry yet high-pressure gas. As indicated by the dashed arrow line in FIG. 2, the dry gas travels along the second air supply pipe 44 and the second inlet 36 of the precooling unit 31 to enter the gas pipeline 32. Finally, the gas is output by the second outlet 37 of the pre-cooling unit 31 for storage in a gas storage barrel (not shown) or for direct use. The low-temperature high-pressure gas output by the drainer 43 enters the gas pipelines 32 through the second inlet 36 of the pre-cooling unit 31. Therefore, the pre-cooling unit 31 can have a pre-cooling effect on the moist high-temperature gas entering via the first inlet 34 thereof. The grating plates 33 further elongate the time of the high-pressure gas staying inside the pre-cooling unit 31, thereby enhancing the cooling effect.

Figure 3:
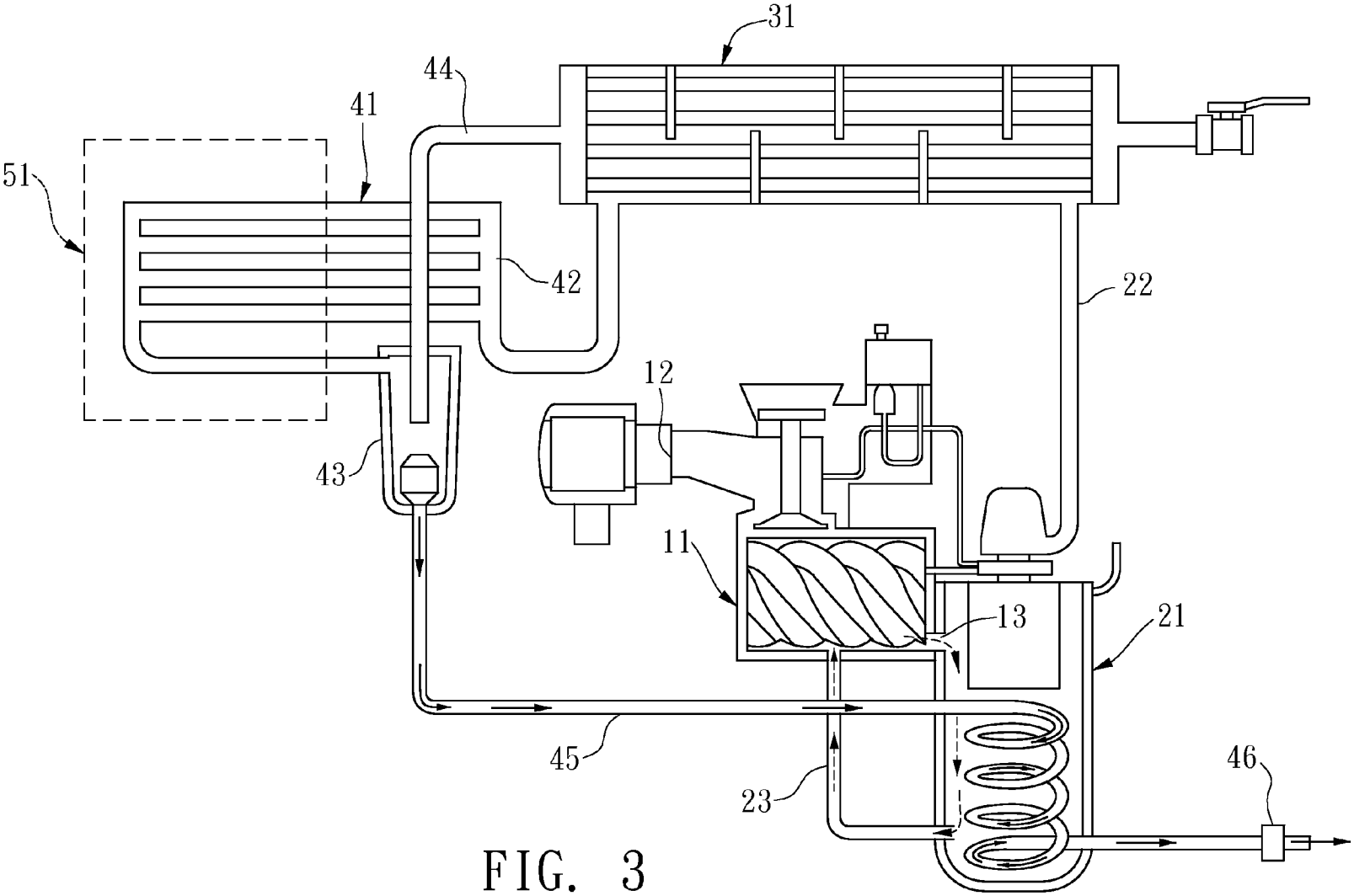
FIG. 3 is a schematic view of the path of the condensed water in the invention.
Figure 4:
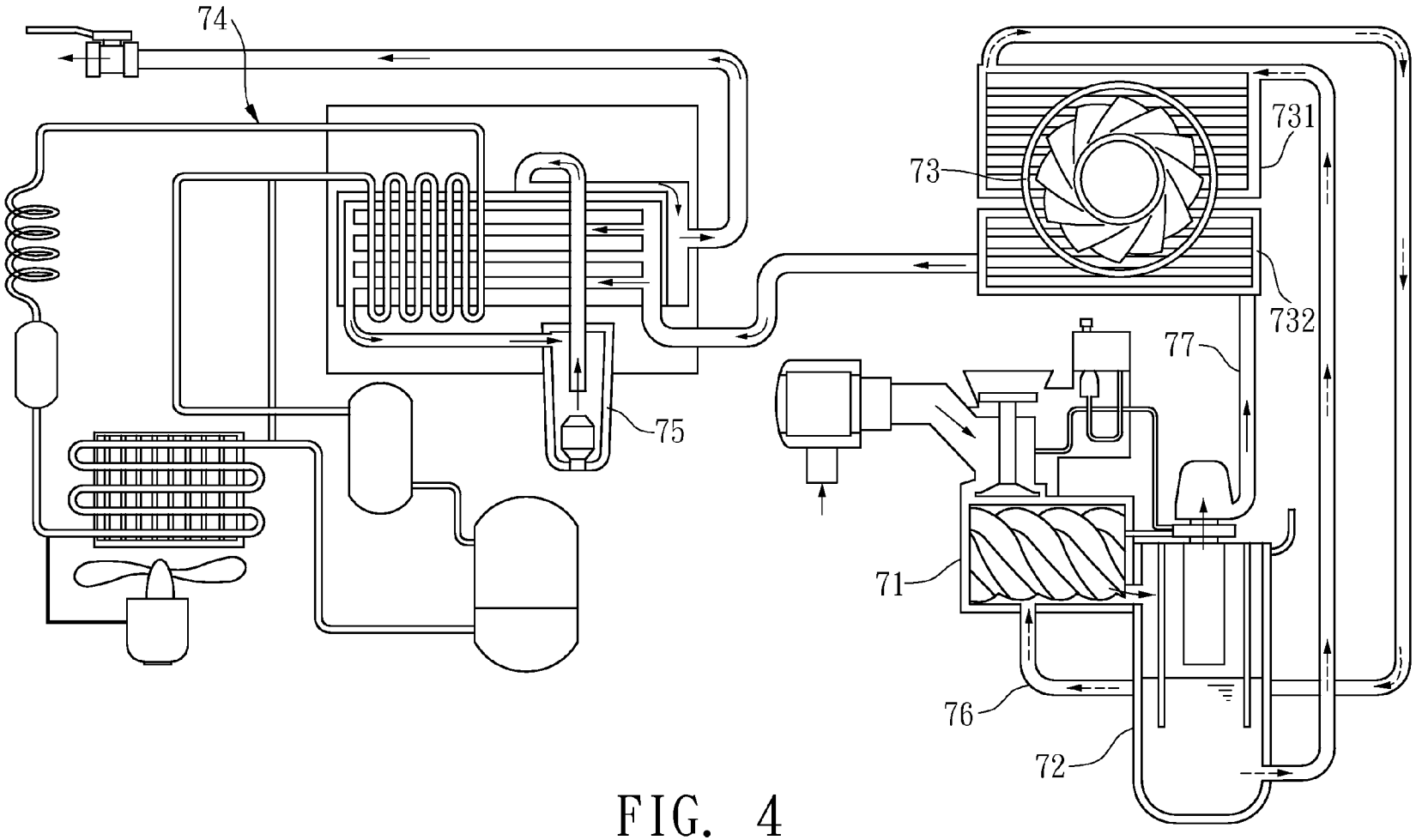
FIG. 4 PRIOR ART
FIG. 4 is a schematic view of the conventional air compressor system.

Please refer to FIG. 3. As indicated by the arrow in the drawing, the moisture removed by the drainer 43 travels along the drainer line 45 and thus through the liquid-gas separator 21 to leave. The moisture removed by the drainer 43 is also cooled by the pre-cooling unit 31 and the heat exchanger 51. Thus, its has a lower water temperature. By arranging a continuous meander path for the drainer 45 in the liquid-gas separator 21, the moisture has a significantly larger contact area with the liquid in the liquid-gas separator 21, thereby effectively lowering the temperature of the moisture in the liquid-gas separator 21. The liquid then reflows back to the air compressor for further uses (as indicated by the dashed arrow lines in FIG. 3).

In summary, the invention does not need an external fan to achieve an excellent cooling effect on the high-pressure gas output by the air compressor and the lubricant liquid therein. Therefore, it has the advantages of energy-saving, no noise, and a reduced size of the device. The invention recycles condensed water to low the temperature of the lubricant liquid. It is thus environmentally friendly.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A gas supply device, comprising:

an air compressor having an inlet and an outlet;

a liquid-gas separator disposed at the outlet of the air compressor; wherein the air compressor discharges high-temperature, high-pressure gas containing a liquid to the liquid-gas separator, the separated high-temperature gas is output via a first air supply pipe, and the separated liquid flows via a reflow pipeline back to the air compressor; and a freeze-drying mechanism having a cooling pipeline connected with the first air supply pipe and a heat exchanger surrounding the cooling pipeline to cool the high-pressure gas therein, the outlet of the cooling pipeline having a drainer for removing moisture of the high-pressure gas entering the cooling pipeline, and the drainer having a second air supply pipe and a drainer line; wherein the drainer line extends and goes through the liquid-gas separator, the moisture-removed high-pressure gas is output via the second air supply pipe, and the removed moisture travels along the drainer line and through the liquid-gas separator to leave.

2. The air supply device of claim 1, wherein a pre-cooling unit is interposed between the first air supply pipe and the cooling pipeline, the pre-cooling unit having a hollow barrel shape, a plurality of gas pipes horizontally across the interior thereof, a first inlet, a first outlet, a second inlet, and a second outlet, the first inlet and the first outlet are in communications with the internal space of the pre-cooling unit, the second inlet and the second outlet are in communications with the gas pipes, the first air supply pipe connects to the first inlet, the cooling pipeline connects to the first outlet, and the second air supply pipe connects to the second inlet.

3. The gas supply device of claim 2, wherein there are a plurality of alternately disposed grating plates inside the pre-cooling unit.

4. The gas supply device of claim 1, wherein the drainer line inside the liquid-gas separator has a continuous meander shape.

5. The gas supply device of claim 1, wherein the outlet of the drainer line is provided with a timing valve for controlling the outlet of the drainer line to open.

6. The gas supply device of claim 1, wherein the heat exchanger is a refrigerant heat exchange structure.

7. The gas supply device of claim 1, wherein the heat exchanger is a refrigeration chipset.

* * * * *